United States Patent [19]

Vieux et al.

[11] Patent Number: 4,980,561

[45] Date of Patent: Dec. 25, 1990

[54] INPUT SCREEN SCINTILLATOR FOR AN X-RAY IMAGE INTENSIFIER TUBE AND MANUFACTURING PROCESS OF THIS SCINTILLATOR

[75] Inventors: Gérard Vieux, Grenoble; Henri Rougeot, Saint Nazaire les Eymes; Paul de Groot, St Ismier; François Chareyre, St Egreve, all of France

[73] Assignee: Thomson-CSF, Paris, France

[21] Appl. No.: 295,391

[22] Filed: Jan. 10, 1989

[30] Foreign Application Priority Data

Jan. 13, 1988 [FR] France ..... 88 00297

[51] Int. Cl.[5] ..... G21K 4/00

[52] U.S. Cl. ..... 250/486.1; 250/483.1

[58] Field of Search ..... 250/486.1, 483.1

[56] References Cited

U.S. PATENT DOCUMENTS 4,287,230 9/1981 Galves et al. ..... 427/255.7 X
4,398,118 9/1983 Galves et al. ..... 250/213 R X
4,803,366 2/1989 Vieux et al. ..... 250/486.1

FOREIGN PATENT DOCUMENTS 0215699 3/1987 European Pat. Off. .
2108385 5/1972 France .

OTHER PUBLICATIONS

Patent Abstracts of Japan, vol. 8, No. 139 (E-253) [1576], Jun. 28, 1984.
Patent Abstracts of Japan, vol. 8, No. 239 (E-276)[1676], Nov. 2, 1984.

*Primary Examiner*—Constantine Hannaher
*Assistant Examiner*—Jacob M. Eisenberg
*Attorney, Agent, or Firm*—Oblon, Spivak, McClelland, Maier & Neustadt

[57] ABSTRACT

The invention concerns an input screen scintillator for an X-ray image intensifier tube. This tube comprises light-conductive cesium iodide needles formed on an electrically conductive substrate. According to the invention, each needle is entirely coated with a material such as a metal or a semiconductor which reflects the light travelling within the needles and allows an identical potential level in the coating material as in the substrate towards the inside of said needles. The coating can enhance the efficiency and resolution of image intensifier tubes. The invention has applications in the field of X-ray imagery.

4 Claims, 2 Drawing Sheets

INPUT SCREEN SCINTILLATOR FOR AN X-RAY IMAGE INTENSIFIER TUBE AND MANUFACTURING PROCESS OF THIS SCINTILLATOR

BACKGROUND OF THE INVENTION

1. Field of the invention

The invention concerns an input screen scintillator for an X-ray image intensifier tube. It also concerns the manufacturing process of this scintillator.

2. Description of the prior art

X-ray image intensifier tubes are well-known in the prior art. For example, these tubes are used to transform X-ray images into visible images for medical observation.

These tubes consist of an input screen, an optoelectronic device and an observation screen.

The input screen includes a scintillator which converts incident X photons into visible photons. These photons then strike a photocathode which is generally made of an alkaline antimonide. The photocathode is excited by the photons and generates a flow of electrons. The photocathode is not deposited directly on the scintillator but on a conductive underlayer which can reconstitute the charges of the photocathode material. This underlayer can for example be made of alumina, or of indium oxide or a mixture of these two substances.

The electron flow from the photocathode is then transmitted by a system of electron optics which focuses the electrons and sends them towards an observation screen consisting of a luminophore, which then emits visible light. This light can then be converted into television or cinema images, or into photographs.

The input screen scintillator is generally made of cesium iodide needles formed by vacuum evaporation on a substrate. The evaporation process can take place either on a cold or hot substrate. This substrate could preferably be an aluminium substrate. A cesium iodide layer usually 150 to 500 μm thick is then deposited on it.

Cesium iodide deposits naturally as 5 to 10 μm diameter needles. Its refractive index of 1.8 makes it behave like an optical fibre, and this tends to lessen the lateral diffusion of the light generated within it.

FIG. 1 is a schematic drawing showing an aluminium substrate 1 with several cesium iodide needles 2 on it. The aluminium substrate receives a flow of X photons symbolized by vertical arrows. Several examples of the paths along which the visible radiation created by the incident X photons travel within the cesium iodide needles are shown on this drawing. The normal traveling paths of this visible radiation, which are referenced 3, produce a luminous signal at the tips of the cesium iodide needles. However, a lateral diffusion of the light conveyed by the cesium iodide needles also occurs, as is shown by reference 4 on the drawing. This lateral diffusion tends to impair the tube resolution. The quality of the resolution depends on a correct channeling of the light by the cesium iodide needles, but also on the thickness of the cesium iodide layer: thicker layers tend to impair resolution. On the other hand, thicker cesium iodide layers also result in a better absorption of X-rays. A compromise must therefore be found between a sufficient X-ray absorption and a high resolution.

During the manufacturing process, the input screen must be subjected to a heat treatment which can also influence the tube resolution. This heat treatment occurs immediately after the cesium iodide has been vacuum evaporated. The treatment makes the screen luminescent, since the cesium iodide has been doped by sodium or thallium ions. It consists in heating the screen to a temperature of 340° C. for about one hour in a desiccated air or nitrogen atmosphere.

During this heat treatment, which is an absolutely essential step, the scintillator needles coalesce and agglomerate, as shown by the schematic drawing on FIG. 2. This coalescence favors an increased lateral diffusion of light (as is shown by the dotted arrows referenced 4) which impairs the resolution.

In the prior art, it had been suggested to make the input screen scintillator by alternatively evaporating pure cesium iodide and cesium iodide doped with a refractory material to suppress coalescence during the heat treatment. The anticipated result was that needles made of alternate layers of pure cesium iodide and doped cesium iodide would not agglomerate during the heat treatment.

However, this solution failed to work effectively. Moreover, a structure of alternate layers of pure cesium iodide and doped cesium iodide does not at all prevent another serious problem, i.e, the lateral diffusion of light.

It was therefore proposed, as described in the U.S. Pat. No. 4,069,355 published on Jan. 17, 1978, to coat the cesium iodide needles with titania or gadolinium oxysulfide or lanthanum oxysulfide. The use of these deposited materials, which contain a metal, not in a metallic form, but in the form of an oxide or a compound, can partially solve the above-mentioned problems: it prevents needles from coalescing and slightly lowers the lateral diffusion of light, although this lower diffusion does not noticeably increase the scintillator's efficiency.

However, the problem of electrical conduction remains unsolved, even in the above-mentioned patent: any layer coating the needles should permit conduction while avoiding coalescence and the lateral diffusion of light. A good electrical conduction is necessary to increase the scintillator's efficiency by obtaining the same potentials in the coating layer of the needles, in the aluminium substrate on which the needles are formed and at the annular electrode to which the substrate is connected.

A first object of the invention, therefore, is to find a solution for these drawbacks by making a scintillator in which the cesium iodide needles are coated with a highly conductive material to prevent said needles to coalesce while sensibly decreasing the lateral diffusion of light. These goals can be achieved by choosing either a semiconductive material or a metal, to the exclusion of metallic oxides.

SUMMARY OF THE INVENTION

The object of the invention is an input screen scintillator for an X-ray image intensifier tube comprising light-conductive cesium iodide needles formed on an electrically conductive substrate, each needle being entirely coated by a specific material such as a metal or a semiconductor, said material reflecting the light travelling in the needles towards the inside of said needles.

According to another embodiment of the invention, this coating material is diluted in polymerized resin.

The invention also concerns a manufacturing process of a scintillator according to claim 1, in which the coating material is a metal, said metal being directly deposited on the needles by photochemical decomposition in a gaseous phase of the molecules of a compound of said metal.

According to another embodiment of the invention, the method consists in depositing said coating material on the needles by diffusion of a solution of the material in an organic solvent or a polymerizable resin, followed by a heat treatment.

According to another embodiment of the invention, the coating material is a metal and the method consists of depositing said metal on the needles by thermal decomposition of an organometallic compound, said compound having been previously diffused between the needles in a gaseous phase.

According to another embodiment of the invention, the metal is chosen from a list including at least indium, gallium, zinc, tin and lead.

According to another embodiment of the invention, the coating material is a silicon or a germanium semiconductor.

BRIEF DESCRIPTION OF THE DRAWINGS

Other specific features and advantages of the invention will appear more clearly from the following description, made with reference to the appended drawings, of which.

DESCRIPTION OF PREFERRED EMBODIMENTS

Figure 1:
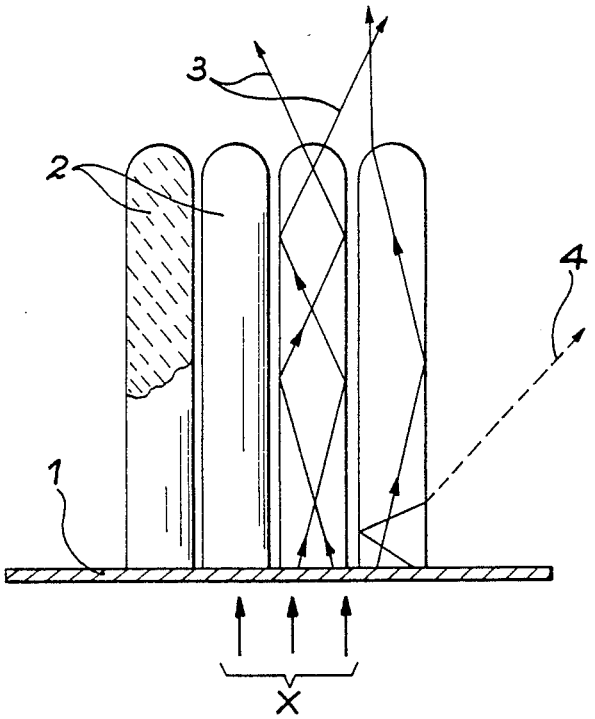
FIGS. 1 and 2 have already been described and show a schematic drawing of a scintillator as known in prior art.
Figure 2:
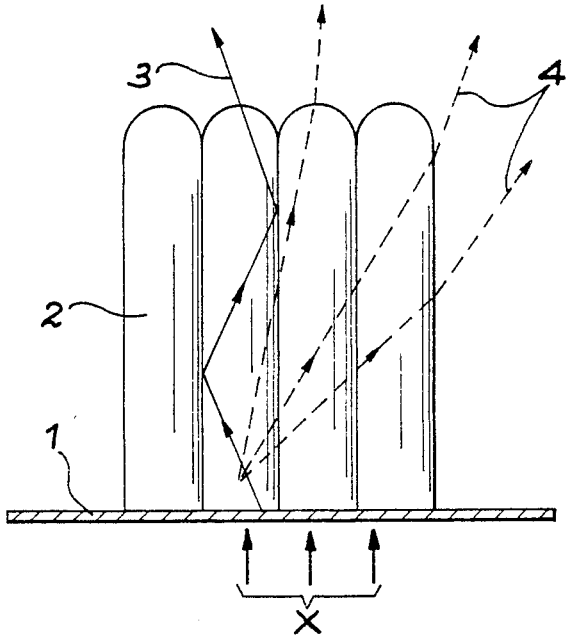
Figure 3:
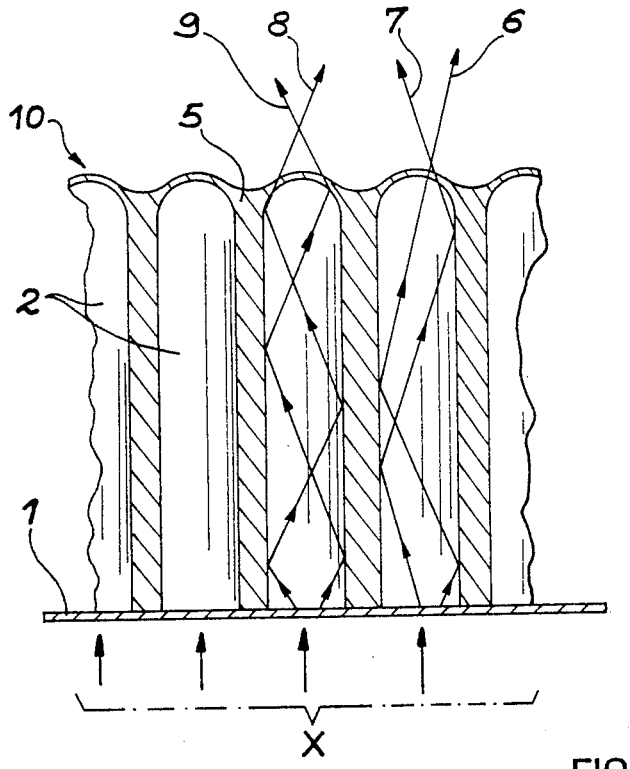
FIG. 3 is a schematic drawing of a scintillator according to the invention.

FIG. 3 is a schematic drawing of the scintillator of the invention, which, as in the prior art, comprises a metallic substrate 1, for example an aluminium substrate, with cesium iodide needles 2 on it. According to the invention, each needle is entirely coated with a material 5, such as a metal or a semiconductor, which reflects the light travelling within the needles towards the inside of said needles. Examples of the paths of the light beams are represented on this figure and are referenced 6, 7, 8, and 9. The needles are coated with this material which is inserted in the intervals between said needles and which acts as an optical barrier, while preventing the needles from coalescing.

The material deposited on the needles is a reflective, metallic or semiconductive material with a high melting point to prevent it from being damaged by the heat treatments involved by the manufacturing process.

The use of such a conductive or semiconductive material makes it possible to obtain the same potentials in the coating layer of the cesium iodide needles as in the substrate. This allows using thinner conductive underlayers in the image intensifier tubes between the scintillator and the photocathode; in some cases they can be eliminated entirely. The efficiency of the scintillator is also thus increased.

The light beams whose paths are referenced 6, 7, 8 and 9 on FIG. 3 are channeled within the cesium iodide needles by the needles' reflective coating layer 5. The angles of incidence of the light beams on the circumference of each needle are such that the beams are reflected towards the inside of the needles. The angle of incidence of the light beams on the output surface 10 of the scintillator is such as they are diffused towards the outside. The coating material on the needles can be a semiconductor such as silicon or germanium, or a metal such as indium, gallium, zinc, tin, lead, etc. If the coating material is a metal, the metal must be in a metallic state, and not in the form of oxides or metallic oxysulfides as is usual with scintillators of the prior art.

According to the invention process, if the coating material is a metal, it is deposited on the needles by photochemical decomposition of the corresponding metallic molecules in a gaseous phase. The substrate and the cesium iodide needles are first placed in a vacuum enclosure. Silane ($SIH^4$) diluted in nitrogen is then injected into this enclosure.

In a temperature range from room temperature to about 200° C., the silane molecules are excited and destroyed by ultraviolet light; if necessary, mercury can be used as a catalyst. During the photodecomposition process, the metal is deposited on the cesium iodide needles.

According to an alternative form of the invention process, the coating material, either a metal or a semiconductor, can be deposited on the needles by diffusion of a solution of the material into an organic solvent or a polymerizable resin. The diffusion is followed by a heat treatment which removes the solvent and leaves a coating of polymerized resin containing the reflective material on the needles.

According to another alternative form of the invention process, if the coating material is a metal, it can be deposited between the needles by thermal decomposition of an organometallic compound, said compound having previously been diffused between the needles in a gaseous phase.

This compound can be in the MXn form, in which M represents the selected metal and X an organic compound such as methyl ($—CH_3$) or ethyl ($C_2H_5$) or any other organic compound comprising hydrogen or chlorine atoms.

The organic compound is diffused in a vacuum. The scintillator is then heated and the organic compound, placed in contact with the needles of the hot scintillator, decomposes into a metal according to the following reaction:

$$MXn \rightarrow M + \text{gaseous products.}$$

The gaseous products are usually hydrogen and hydrocarbons.

With the above-mentioned process, the coating material can be deposited in a thin layer on an essentially vertical substrate formed by the scintillator needles. It has the advantage to overcome the problems of the coating process of the needles, which are mainly caused by the disproportion of the length of the intervals between the needles and the diameter of the needles: these intervals have a length which is roughly about one thousand times larger than the diameter of the needles.

The goals mentioned previously can therefore be achieved with the invention: a solution has been found to channel light within the needles while making the needles' surface electrically conductive and enhancing the efficiency and resolution of the scintillator by suppressing loss of light through lateral diffusion.

Figure 4:
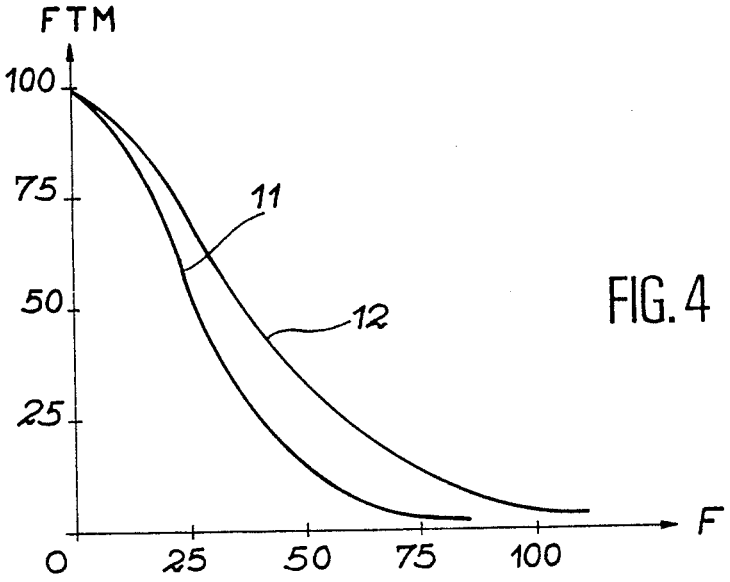
FIG. 4 is a diagram showing the modulation transfer functions (MTF) according to the spatial frequency of the radiation received by the scintillator, for a scintillator as known in prior art and for the scintillator of the present invention.

FIG. 4 is a diagram showing the evolution of the modulation transfer function (MTF) in comparison with the spatial frequency F of received radiation for a scintillator according to the prior art, represented by the curve 11, and for a scintillator according to the invention, represented by the curve 12. This diagram shows that the modulation transfer function (MTF) is much higher in the case of the scintillator of the invention (curve 12) than in the case of a scintillator of the prior art (curve 11). The scintillator of the invention therefore offers a higher resolution and a higher modulation transfer function than the scintillators of the prior art.

What is claimed is:

1. An input screen scintillator for an X-ray image intensifier tube, comprising:

an electrically conductive substrate;

a plurality of light conductive cesium oxide needles formed on said electrically conductive substrate; and coating means for obtaining an identical potential level in said electrically conductive substrate as in said coating means, said coating means coating each needle of said plurality of iodide needles and making contact with said electrically conductive substrate wherein said coating means is a metal or a semiconductor to the exclusion of metallic oxides.

2. A scintillator according to claim 1, wherein said coating means is a metal.

3. A scintillator according to claim 1, wherein said coating means is a semiconductor of composition to the exclusion of metallic oxides.

4. A scintillator according to claim 1, wherein said coating means reflects light travelling within said plurality of needles toward the inside of said plurality of needles.

* * * * *